US005758609A

United States Patent [19]

Smith

[11] Patent Number: 5,758,609

[45] Date of Patent: Jun. 2, 1998

[54] ROTARY TYPE INTERNAL COMBUSTION MOTOR

[75] Inventor: Roger J. Smith, Auckland, New Zealand

[73] Assignee: Continuous Cycle Engine Development Company, Ltd., Auckland, New Zealand

[21] Appl. No.: 698,587

[22] Filed: Aug. 16, 1996

[51] Int. Cl.[6] ..... F02B 57/00

[52] U.S. Cl. ..... 123/44 R; 123/44 C

[58] Field of Search ..... 123/44 R, 44 C, 123/44 D, 54.1, 54.2

[56] References Cited

U.S. PATENT DOCUMENTS

| | | | |
|---|---|---|---|
| 2,103,787 | 12/1937 | McCrary | 123/44 C |
| 2,273,025 | 2/1942 | Dillstrom | 123/44 D |
| 2,395,918 | 3/1946 | Stucke | 123/44 R |
| 2,408,800 | 10/1946 | Meyer | 123/44 R |
| 2,683,422 | 7/1954 | Richards, Jr. | 123/44 R |
| 3,605,564 | 9/1971 | Shoemaker | 91/495 |
| 3,857,371 | 12/1974 | Gibson | 123/44 R |
| 3,931,809 | 1/1976 | Corte et al. | 123/44 R |
| 4,249,487 | 2/1981 | Chambers | 123/44 C |
| 4,612,882 | 9/1986 | Bonfilio | 123/44 R |
| 4,625,683 | 12/1986 | Bonfilio | 123/44 R |
| 4,836,149 | 6/1989 | Newbold | 123/44 R |
| 5,303,679 | 4/1994 | Gamon | 123/44 C |

*Primary Examiner*—David A. Okonsky
*Attorney, Agent, or Firm*—Brinks Hofer Gilson & Lione

[57] ABSTRACT

An internal combustion rotary engine with multiple cylinders and rotary crankcase supported on a pair of engine stub shafts. The connecting rods are each connected to a different center arranged evenly around the drive center of a stepdrive element. The stepdrive element which is polygonal or circular is offset from the rotational axis of the crankcase within which it revolves. The stepdrive element drives the crankcase through a series of links. As each piston fires the connecting rod is inclined to the piston travel axis and the angle between the connecting rod and the stepdrive element center is close to 90 degrees. As the piston moves through its power stroke the cylinder rotates with the crankcase maintaining the mechanically advantageous 90 degree angle for about 100 degrees of crankcase rotation. Symmetric and asymmetric cylinder layouts, Diesel and 2-stroke layouts are disclosed.

20 Claims, 6 Drawing Sheets

ROTARY TYPE INTERNAL COMBUSTION MOTOR

TECHNICAL FIELD

This invention concerns internal combustion motors of the piston in cylinder type.

BACKGROUND ART

The operation of such motors whether Diesel or spark ignition has changed little in a century despite numerous proposals. One disadvantage of the Otto-cycle is the sequence which surrounds top dead centre (TDC). As the piston rises toward TDC, a spark is generated, ignition begins and the piston continues to rise completing compression and resisting the expansion of that part of the charge which has already ignited and is expanding. At TDC the connecting rod and the crankshaft are aligned so that in theory the burning expanding gases have no space in which to expand. The available space for these combustion gases does not increase until TDC is passed and the connecting rod is once more inclined to the piston axis and the inclination of the connecting rod once more offers mechanical advantage to the piston.

The provision of a spark before TDC tends to reverse the rotation of the motor. Were it not for the flywheel carrying the piston past TDC, pulsation reversion would act to arrest and reverse the motor's rotation.

This small sector of cycle illustrates what is lacking in the concept and present application of the Otto-cycle.

Petrol engines utilising the Otto-cycle require a high ratio of fuel to air. Incomplete combustion and the internal deposition of carbon is therefore common. Unfavourable emissions are also a consequence of these ratios.

SUMMARY OF THE INVENTION

The multi-cylinder aspect of the invention provides an internal combustion motor of the piston in cylinder type wherein the or each piston may exert drive through linkage which permits a phase difference between piston movement and the drive take-off whereby in use the working stroke may begin at or after the highest compression point (HCP). Such a motor may have pistons reciprocable in cylinders, arranged radially in a rotatable crankcase having an axis of rotation, a stepdriver element connected to the pistons, the axis of rotation of the stepdriver element being offset from the axis of rotation of the crankcase, the crankcase and cylinders in use rotating around the stepdriver element while the pistons reciprocate, and means to take power from the rotatable crankcase.

Much of the chemical energy of fuel appears as heat. It appears that some of the heat is the result of work done needlessly by a motor through poor design of the capture of reciprocating motion. Preferably the connecting rods may be connected to the stepdriver element so as to take mechanical advantage by inclination of the rods to the piston travel axis, which advantage is maintained through substantially half the power stroke by simultaneous rotation of the crankcase and cylinders.

The stepdriver element may be connected to the pistons such that in use the working stroke begins when the connecting rod is inclined to the piston travel axis after (HPC) rather than at alignment or before alignment as in conventional motor operation.

This is achieved by arranging the axes of the links to be other than parallel to the piston travel axis at HCP. Even small inclinations of the linkage ease the position where the linkage directly opposes the descending piston.

The pistons may be in opposed pairs. When there are two or more pairs of pistons the piston and cylinder assemblies may be arranged radially on the crankcase. Alternatively there may be an uneven number of cylinders but whatever the number it is preferable that the cylinders are disposed evenly around the crankcase. The pistons may rotate a stepdriver in the crankcase through conventional connecting rods. The rotational centre of the stepdriver may be offset from the corresponding rotational centre of the crankcase by half the length of the piston stroke. The stepdriver may drive the crankcase at the same rpm through a link assembly such as a trio of links or pairs of links or a mechanical equivalent.

The crankcase and associated cylinders are free to rotate about a stationary shaft which is supported on motor mounts. The motor is suited to air cooling and may run inside a housing with air vents or passages to promote heat exchange. The gearbox input shaft may be driven from a take-off shaft or a gear fixed to the crankcase coaxially with the support shaft axis. A starter ring may be bolted to the crankcase to permit conventional starting.

The above geometry makes it possible for four cylinders to be fixed at NSEW positions wherein the pistons both drive a stepdriver while simultaneously rotating about the stepdriver each requiring only an aliquot crank angle allowing the stepdriver position in the crankcase to remain constant while the stepdriver drives the crankcase about the crankcase rotational axis through the link assembly.

The stepdriver may be a circular or polygonal, a spider or other mechanical equivalent. When circular or polygonal the stepdriver diameter may be 60–70% of the crankcase diameter.

Two novel motions are provided by this geometry. In the invention a pair of opposed cylinder and piston assemblies, the centre of the stepdriver, the big ends of the two connecting rods and the rotational axes of a pair of the parallel links may all be in alignment. This causes the connecting rod to lie on the hypotenuse of a 90\60\30 degree triangle namely at 30 degrees to piston travel at HPC. The subsequent displacement of the connecting rod from the piston axis during the working stroke maximises the conversion of gas expansion to rotational motion.

Secondly the progress of the crankcase carries the assemblies to positions in which the individual motion of the connecting rod cluster do not mutually interfere even though they work in the same plane. Thus the stepdriver shaft may remain static while stepdriver and the radial assemblies all rotate about the stepdriver shaft.

When there are four cylinders and four links, the big ends of one pair of connecting rods may lie on the line joining the stepdriver axis with the axes of one pair of links. The remaining pair of big ends and the remaining link axes lie perpendicular to the first pair. The links are thus parallel with a line joining the axis of the crankcase and stepdriver. This allows the piston 180 degrees of advancement in expansion, rotating the stepdriver from 3 o'clock to 9 o'clock. The links move from 12 o'clock to 6 o'clock. This operation occurs four times per crankcase revolution.

For the four cylinder layout referred to above the links connecting the stepdriver to the crankcase assist the balance of the couple generated by the rotation of the assembly. Stepdriver balance is achieved by the addition of balance weights to one or more, usually all four of the links. The rim speed of the crankcase clearly exceeds that of the smaller stepdriver.

Air intake and exhaust output may be via passages between the crankcase and the cylinder. Side valve, o h valve and o h c arrangements are possible. When the motor operates as Diesel an injector supplies fuel. When spark ignition is utilised fuel injection may supply the fuel. A carburettor and crankcase induction may be substituted.

The advantage angle offered by the above layouts may be 4°–100°. Useful torque increase is possible in the range 4°,5°,6°, 10° to 15° to 20° to 30° to 40° to 45° but we have found better results in the range 90° to 95° to 100° to 105° to 110°.

The advantage angle has its counterpart in the fraction of the working stroke performed by the piston. At the start of the stroke 68% of the stroke uses mechanical advantage by best likage; at the end of the stroke it is 59%; in between it subsides at 80%.

A dry sump keeps the crankcase free from liquid. A small dosing pump provides the crankcase interior with oil mist This reaches the cylinder walls, small ends and the links.

Ignition is preferably by Diesel injector but coil ignition and electronic spark generators are operable. A rare earth magnet fixed to the motor may activate a stationary field detector which switches on a transistor. The transistor directs coil discharge to a spark plug. The stationary spark plug may be mounted in the housing which encircles the path of the cylinders but is separated by an air gap. The Hall effect produces the supply of inductive signals to the electronic switch.

BRIEF DESCRIPTION OF THE DRAWINGS

Certain embodiments are now described with reference to the accompanying drawings in which.

BEST MODE OF CARRYING OUT THE INVENTION

Figure 1:
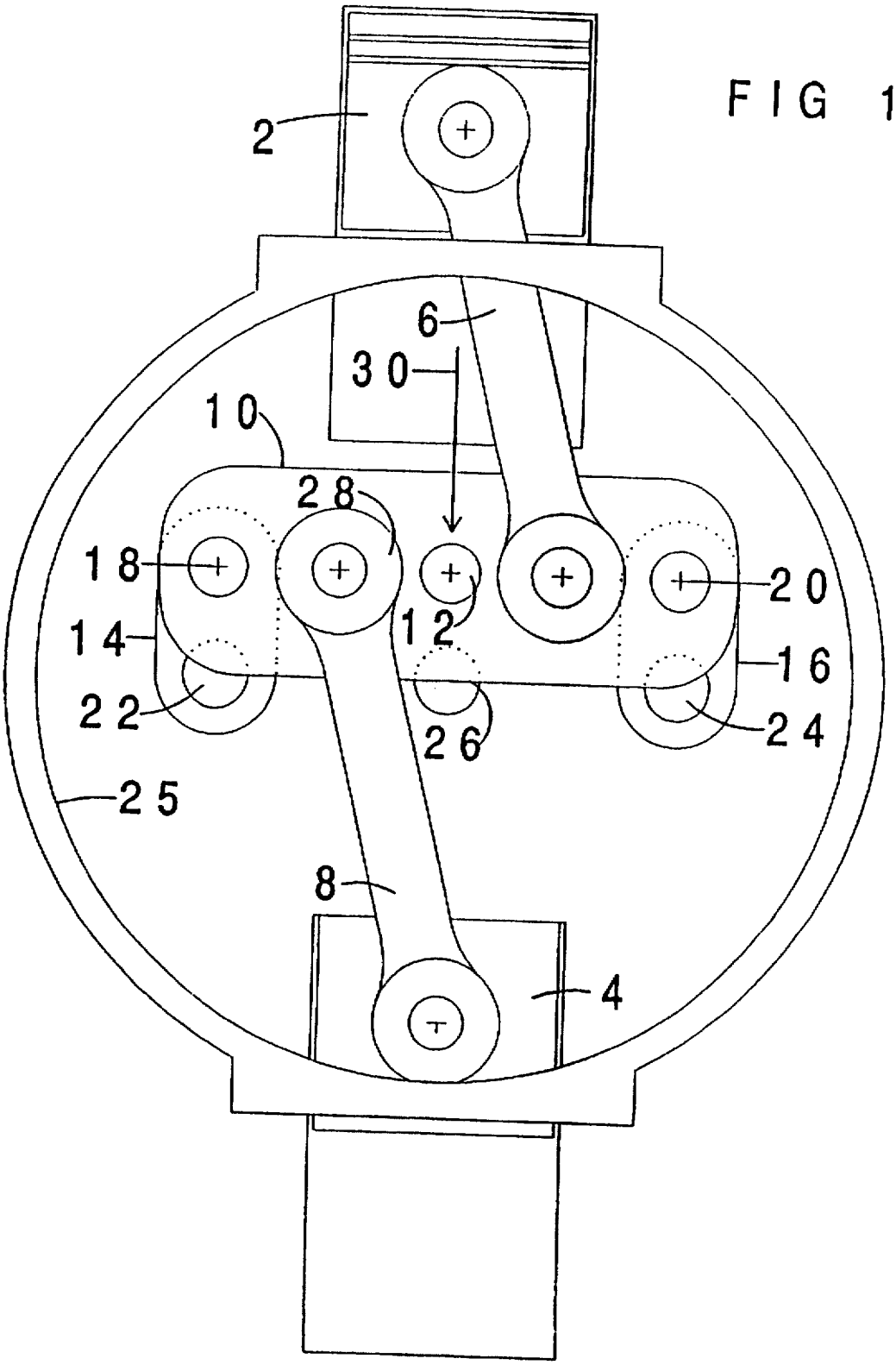
FIG. 1 is a sectional diagram of an opposed twin cylinder motor.

In FIG. 1 the opposed pistons 2,4 are connected by connecting rods 6,8 to stepdriver 10. Stepdriver 10 rotates around centre 12. Links 14,16 are connected to the stepdriver at centres 18, 20 and to the crankcase at centre 22,24. The crankcase rotates about axis 26. Only half the links are shown in this Figure for clarity. The big end 28, 30 link axes 18, 20 and stepdriver centre 12 are aligned when piston 2 is at HCP and piston 4 is at LCP.

It will be seen that the assembly is balanced at this position. Link 6 is inclined to the piston travel axis and the axis 30 is at 90 degrees to the piston travel axis. Likewise the links lie at 90 degrees to the connecting rod alignment axis.

Figure 2:
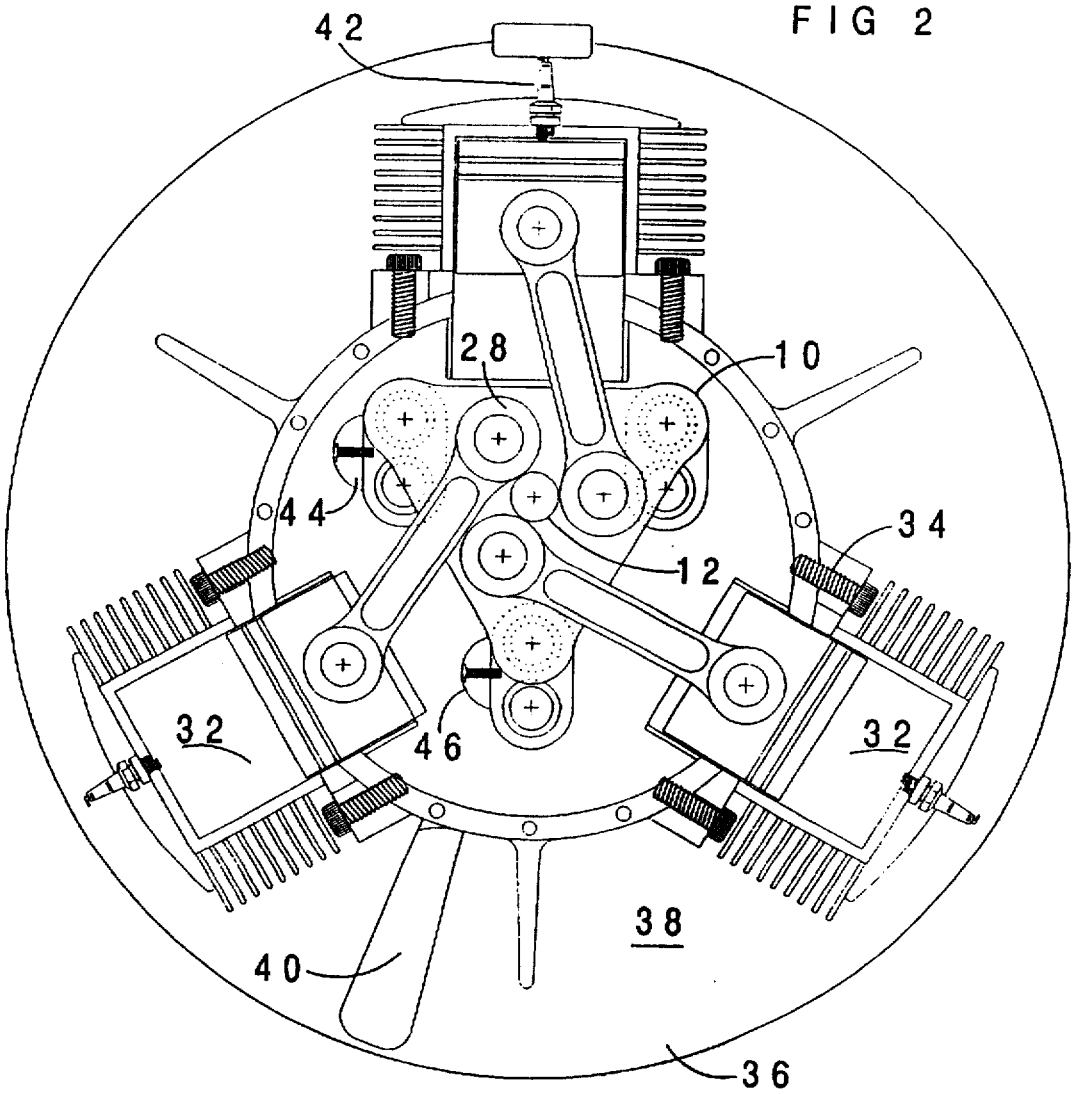
FIG. 2 is a sectional diagram of a 3-cylinder motor.
Figure 3:
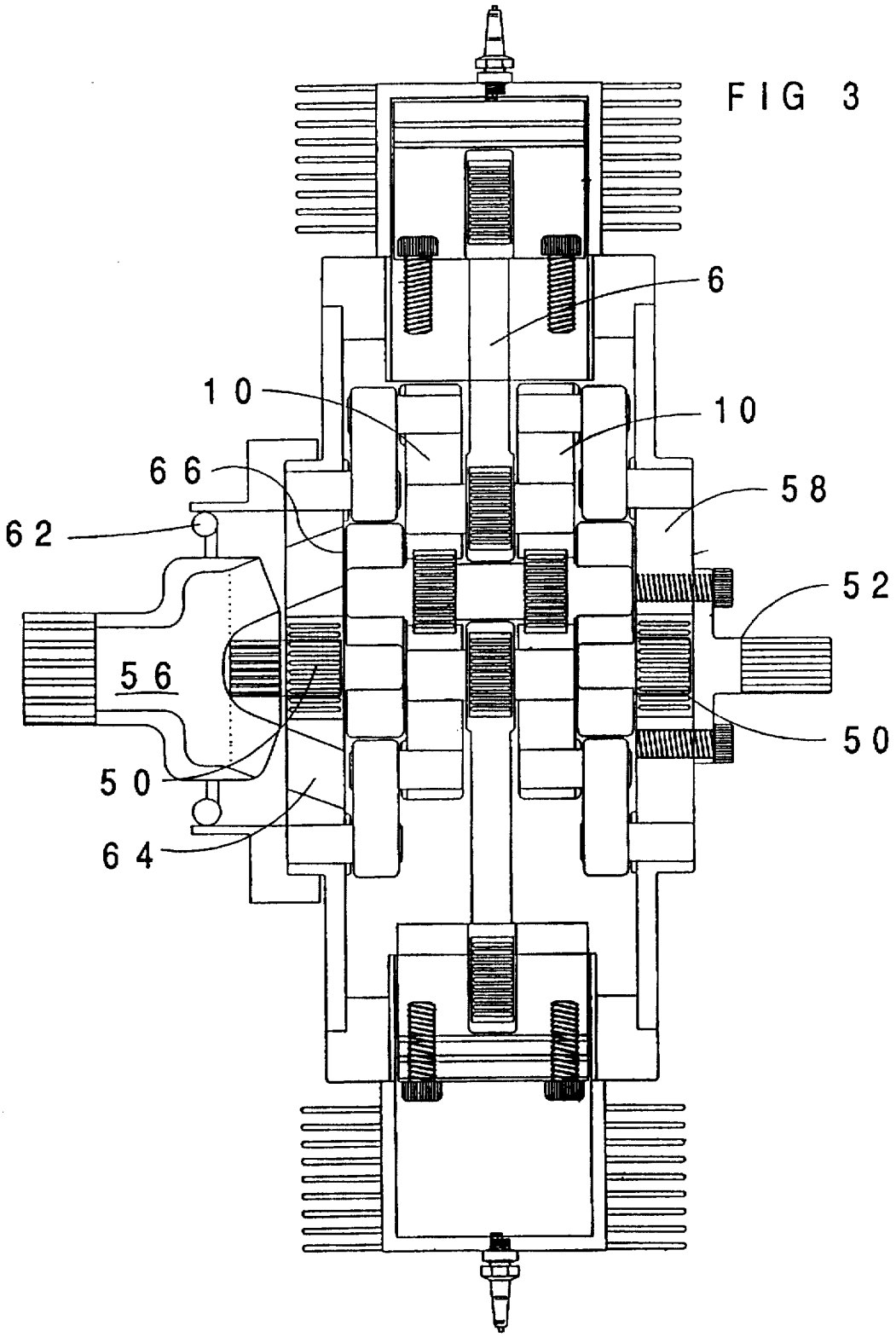
FIG. 3 is a diagrammatic section of FIG. 1 from "A" showing the stepdrive and links connection to crankcase.

In FIGS. 2,3 more motor parts are shown. Two cylinder pairs as shown in FIG. 2 are assembled radially. The four cylinders 32 are secured to the crankcase by bolts 34 which pass through the cylinder walls. Motor housing 36 has a cylindrical race 38 in which the motor revolves. Louvres 40 in the housing provide gas exchange for cooling. Each cylinder has a conventional spark plug 42. The disposition of balance weights 44, 46 on two of the three pistons is shown. These compensate the off-centre weight distribution of the pistons during running.

In FIG. 3 the drive linkage of a pair of cylinders is shown. The crankcase revolves around a splined motor support shaft 52 extending from bearings 50 and stationary hollow shaft 56 which is part of the assembly. The engine 58 turns on bearing 50. Seal 62 keeps the crankcase gastight. Shaft 52 engages the coupling of a transmission gearbox (not shown)

The crankcase interior is charged by a Rootes blower (not shown) at 1.5 psi with air\fuel mix through hollow shaft 56. A pressed metal engine mount (not shown) is bolted within the engine compartment in order to support the engine adjacent the gearbox. The mount is movable away from the motor to release it for repair. The blower feeds hollow shaft 56 through an aperture in the mount.

The manifold 64 registers with a ring of circular ports 66 in the crankcase wall. The revolving links 14,16 do not impede the entering fuel\air mixture. The cylinders exhaust directly into the housing.

Figure 5:
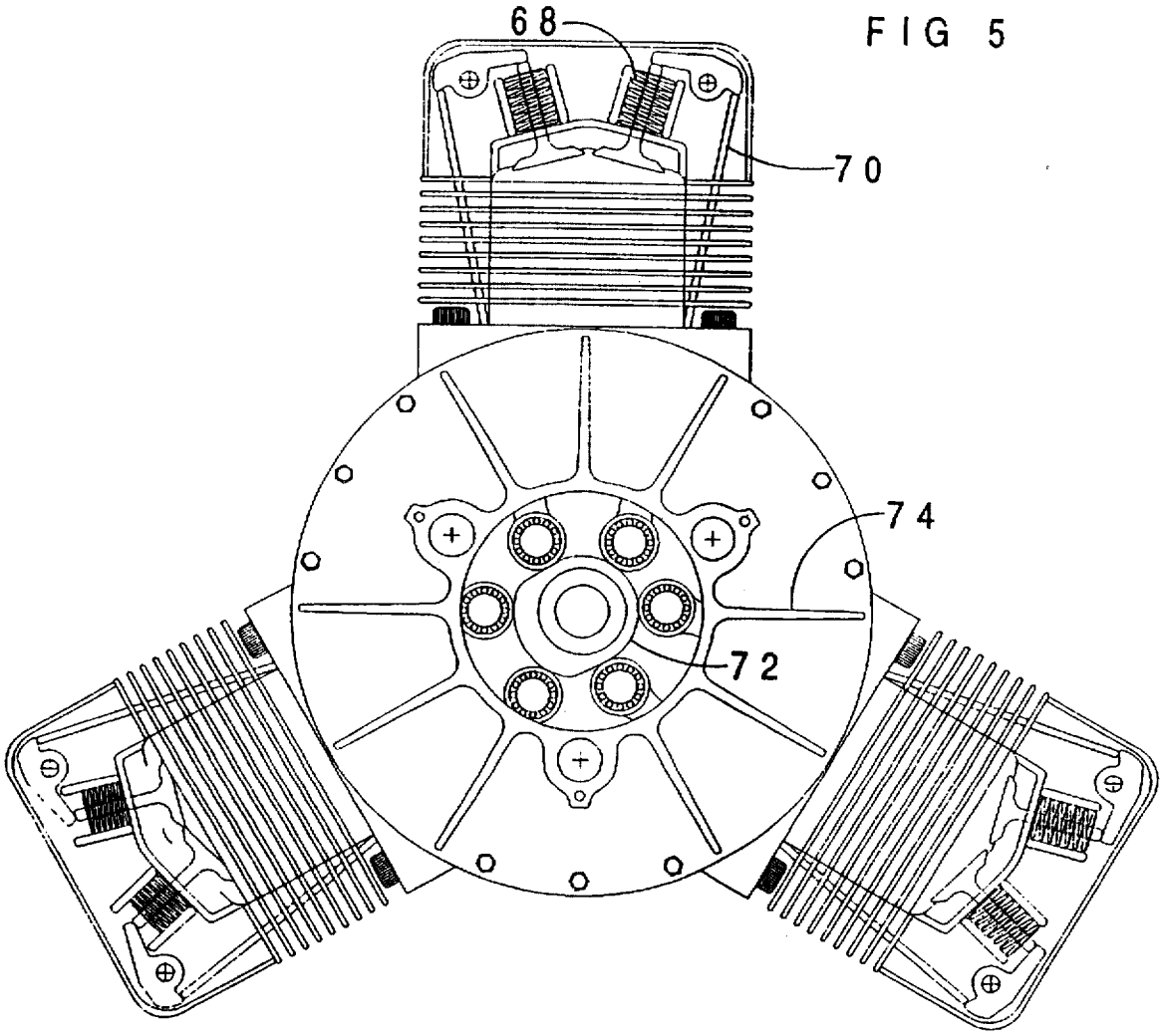
FIG. 5 is a diagram of a 3-cylinder OHV motor

In FIG. 5 a coaxial pump (not shown) injects fuel into the cylinders via lines (not shown). O H valves 68 are worked by pushrods 70 from a central cam 72. Fan blades 74 extend from the side of the crankcase.

Figure 6:
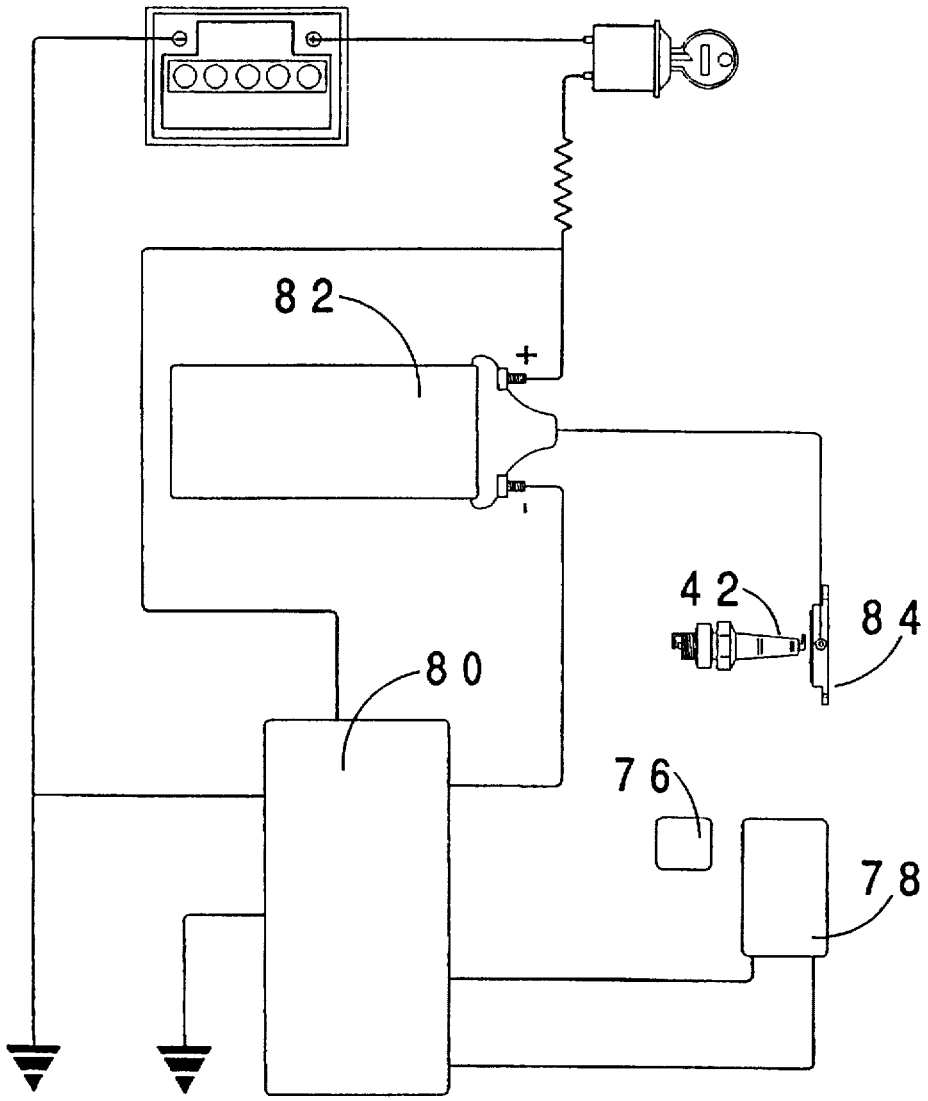
FIG. 6 is a diagram of an spark ignition setup for the motor.

In FIG. 6 samarium-cobalt magnets 76 are fixed to the crankcase at NSEW locations. The magnets excite a detector 78 and send signals to an electronic ignition circuit 80. The circuit contains a switching transistor which controls the supply of low voltage pulses to a conventional coil 82. An insulated plate 84 is fixed to the static housing 36. A conducting pole 88 in the plate 84 receives high voltage pulses from the coil 82. The spark jumps the air gap as the spark plug 42 passes the plate 84.

Figure 4:
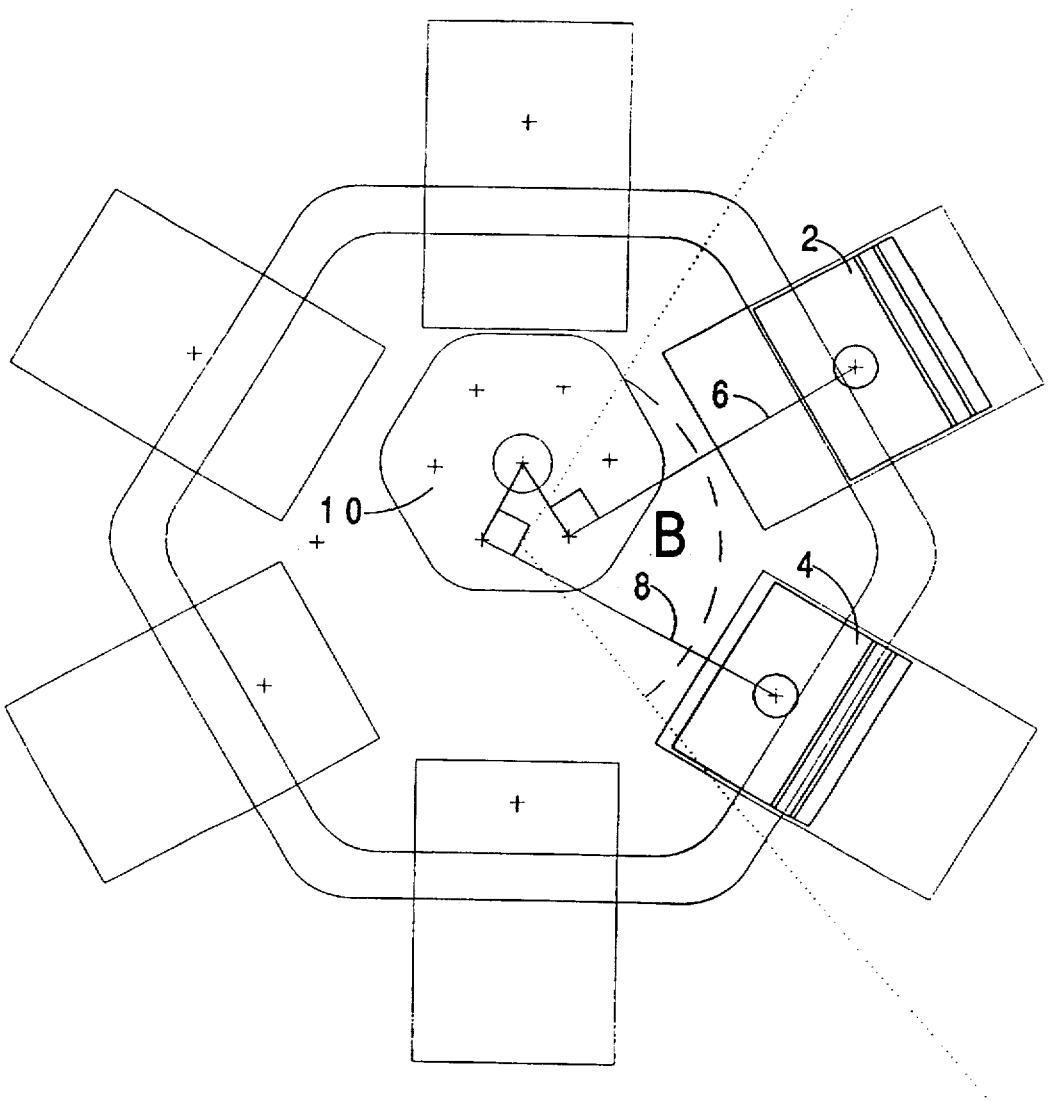
FIG. 4 is a diagram of a six cylinder motor with two cylinders in the optimum drive position over a 100 angle of crankcase rotation.

The operation is as follows. The crankshaft rotation is anticlockwise. The power stroke occupies 195 degrees. The sequence is best seen from FIG. 4. The cylinder 2 is ready to fire. The big end of the connecting rod is at 90 degrees to the stepdriver centre in relation to the piston travel axis.

In the corresponding position in an Otto-cycle motor the gudgeon, connecting rod and crank would be aligned. The diagram shows that as the piston executes its stroke the crankcase rotation keeps pace so that the piston has the same mechanical advantage 100 degrees later. This favourable angle B is shown. The links ensure the rpm of the stepdriver and crankcase are equal. The piston stroke extends for about 195 degrees of crankcase rotation. Thus about half of the power stroke is at favourable mechanical advantage. Rotation continues for a further 90 degrees during which exhaust occurs.

Intake begins. The same big end is still displaced by 90 degrees from the conventional position. At this halfway point a symmetrical cylinder geometry is not possible. This is dealt with by adding weights to the links in order to restore dynamic balance to the assembly (see FIG. 2). Crankcase pressure charges the cylinder and the cylinder Simultaneously the crankcase advances preserving the relative positions of the cluster of big ends. Compression rises quickly through a small arc placing the big end in the working stroke position ready for firing.

The data below shows the cranking arc for different phases of piston movement wherein the swept stroke is 90 mm; the compression stroke is 75 mm; the port depth is 15 mm.

| | | |
|---|---|---|
| HCP to start of Exhaust port(EP) | 162 | 45% |
| EP start to end of EP | 90 | 25% |
| End of EP to HCP | 108 | 30% |

If the motor requires 135 or 37.5% of cranking arc then the following formula applies:

| | | |
|---|---|---|
| HCP to start of EP | 139.5 | 38.75% |
| EP start to end of EP | 135 | 37.5% |
| End of EP to HCP | 85.5 | 23.75% |

Regardless of port size which alters the crank degrees between start and end of EP the difference between HCP to EP and EP to HCP remains the same. The power stroke is 54° longer than the compression stroke.

We consider the advantages of the embodiment to be:

1 Ignition is synchronised with an advantageous arc of the stepdriver.

2 Although the linkage introduces imbalance, the linkage also affords assistance in the balancing of the rotating parts.

3 Low carbon fuels suffice because excess air is available for oxidation.

4 Driving the crankcase through a stepdrive enables the connecting rod to remain at a mechanically advantageous position for about 100 degrees of the 195 degree working stroke instead of 3 degrees as in a conventional crank motor.

I claim:

1. An internal combustion motor with reciprocable pistons in cylinders, arranged radially in a rotatable crankcase having an axis of rotation, a stepdriver element connected to the pistons, the axis of rotation of the stepdriver element being offset from the axis of rotation of the crankcase, the crankcase and cylinders in use rotating around the stepdriver element while the pistons reciprocate, and means to take power from the rotatable crankcase and wherein the crankcase is driven by at least two links pivotally mounted to the stepdriver and crankcase respectively to drive simultaneous rotation of the crankcase and stepdriver at the same rotational speed and in the same direction about their respective axes.

2. An internal combustion motor as claimed in claim 1 wherein the crankcase is driven by a link assembly connected between the crankcase and the stepdriver element.

3. An internal combustion motor as claimed claim 1 or 2 wherein the rotational axes of crankcase and stepdriver element are offset by half the length of a piston stroke.

4. An internal combustion motor as claimed in claim 1 or 2 wherein the crankcase rotates about a stationary shaft supported on motor mounts.

5. An internal combustion motor as claimed in claim 1 or 2 wherein the crankcase and cylinders rotate inside a housing which promotes heat exchange.

6. An internal combustion motor as claimed in claim 1 or 2 wherein the stepdriver element is circular, polygonal, a spider or mechanical equivalent.

7. An internal combustion motor as claimed in claim 1 wherein the stepdriver element size is 60–70% of the diameter of the crankcase.

8. An internal combustion motor as claimed in claim 7 wherein a pair of opposed piston and cylinder assemblies are connected to the stepdriver element by connecting rods and the stepdriver element rotational axes, the big ends of the connecting rods and the rotational axis of the pair of links are all in alignment.

9. An internal combustion motor as claimed in claim 7 wherein four cylinders arranged in two opposed pairs are connected to the stepdriver element by connecting rods and the big ends of one pair of an opposing pair of rods lie on axes joining the stepdriver element axis with the axis of one pair of links and the remaining pair of links and big ends and link axes lie perpendicular to the one pair of links so that the links are parallel with a line joining the rotational axes of the crankcase and stepdriver element.

10. An internal combustion motor as claimed in claim 7 wherein when the piston advances, moving the stepdriver element from 3 o'clock to 9 o'clock the links move from 12 o'clock to 6 o'clock and such advance occurs four times each revolution.

11. An internal combustion motor as claimed in claim 7 wherein a balance weight is attached to the or each link.

12. An internal combustion motor as claimed in claim 10 wherein the cylinders are charged with a fuel\air mix by crankcase induction, an inlet chamber being arranged coaxially around one motor shaft mount while the exhaust chamber is arranged coaxially around the opposite motor shaft mount.

13. An internal combustion motor as claimed in claim 1 or 2 or 7 or 10 wherein the cylinders have pushrod operated poppet valves and the pushrods are lifted by a cam revolving about the crankcase rotational axis.

14. An internal combustion motor as claimed in claim 1 wherein as the crankcase rotates through 80°–100° a piston moves through 45°–55° of its working stroke.

15. An internal combustion motor with reciprocable pistons in cylinders arranged radially in a rotatable crankcase having an axis of rotation, a stepdriver element connected to the pistons and to said crankcase by pairs of links, the rotational axis of which is offset from the crankcase axis, the pistons each having a connecting rod connected to the stepdriver element so as to take mechanical advantage by inclination of the connecting rods to the piston travel axis, which advantage is maintained through substantially half the power stroke by simultaneous rotation of the crankcase and cylinders.

16. An internal combustion motor as claimed in claim 15 wherein the advantageous rotation is 4–100 degrees.

17. An internal combustion motor as claimed in claim 15 wherein the advantageous rotation is 45–100 degrees.

18. An internal combustion motor as claimed in claim 15 wherein the advantage angle is 90–110 degrees.

19. An internal combustion motor as claimed in claim 15 wherein the angle corresponds to 59–80% of the power stroke.

20. An internal combustion engine as claimed in claim 15 wherein the angle corresponds to 59–68% of the power stroke.

* * * * *

UNITED STATES PATENT AND TRADEMARK OFFICE

CERTIFICATE OF CORRECTION

PATENT NO. : 5,758,609

DATED : June 2, 1998

INVENTOR(S) : Roger John Smith

It is certified that error appears in the above-indentified patent and that said Letters Patent is hereby corrected as shown below:

Title page, item [73],

Change the Assignee from "CONTINUOUS-CYCLE ENGINE DEVELOPMENT CO. LTD." to -- THE CONTINUOUS-CYCLE ENGINE DEVELOPMENT CO. LIMITED --

Signed and Sealed this

Fifteenth Day of September, 1998

*Attest:*

*Attesting Officer*

Bruce Lehman

BRUCE LEHMAN

*Commissioner of Patents and Trademarks*